US006382727B1

(12) United States Patent
Pickard

(10) Patent No.: US 6,382,727 B1
(45) Date of Patent: May 7, 2002

(54) FOLDABLE CHAIR

(76) Inventor: Peter B. Pickard, RD #7, Box 142, Rome, NY (US) 13440

( * ) Notice: Subject to any disclaimer, the term of this patent is extended or adjusted under 35 U.S.C. 154(b) by 0 days.

(21) Appl. No.: 09/739,487

(22) Filed: Dec. 18, 2000

(51) Int. Cl.[7] ..... A47C 1/034
(52) U.S. Cl. ..... 297/423.36; 297/30; 297/423.3
(58) Field of Search ..... 297/30, 423.36, 297/423.3, 423.31, 69, 70

(56) References Cited

U.S. PATENT DOCUMENTS 3,743,349 A * 7/1973 Crum et al. ..... 297/69
4,076,303 A * 2/1978 Korenblit ..... 297/30
5,328,247 A * 7/1994 Lovins ..... 297/423.3
5,597,210 A 1/1997 Pickard

* cited by examiner

*Primary Examiner*—Anthony D. Barfield
(74) *Attorney, Agent, or Firm*—Wall Marjama & Bilins LLP

(57) ABSTRACT

A foldable deck chair having a leg support unit that can be manually retracted into a stored position beneath the chair seat and raised into a horizontally extended position in front of the seat by a person seated in the chair. A pair of support members are rotatably supported upon the front legs of the chair so that they can be rotated by a person seated in the chair between raised upper and a lowered down position. A leg support frame is movably mounted in parallel guideways formed in the support member and the motion of the frame is regulated with that of the supporting arms through a control linkage so that the frame is retracted along the support members when the members are lowered into the down position and is extended along the support members when the members are raised to the up position.

9 Claims, 5 Drawing Sheets

35
30,31
27
13,14
12
40
15,16
10
18,19
20
24
22,23

FOLDABLE CHAIR

FIELD OF THE INVENTION

This invention relates generally to a foldable beach or deck chair and more specifically, to a foldable beach or deck chair having a leg rest that can be manually placed in a stored position beneath the chair seat when not in use or when the chair is folded and brought to an extended generally horizontal position when placed in use.

BACKGROUND OF THE INVENTION

As described in U.S. Pat. No. 5,597,210, a deck chair having a manually operated leg rest has been developed by the present applicant which can be conveniently operated by a person while seated in the chair. This prior art chair operates quite well in practice, however, the mechanism for controlling the extension and retraction of the leg support unit utilizes two independent guide rails. The linkage for connecting the guide rails to the leg support unit, therefore, contains a rather larger number of interrelated parts.

SUMMARY OF THE INVENTION

It is therefore an object of the present invention to improve deck chairs and, in particular, deck chairs employing retractable leg support units.

It is a further object of the present invention to improve the operation of a retractable leg supporting unit that is attached to a deck chair.

A still further object of the present invention is to reduce the number of component parts needed to operate a retractable leg rest unit that is attached to a foldable deck chair.

Another object of the present invention is to enhance the portability of a foldable deck chair that is equipped with a retractable leg support unit.

These and other objects of the present invention are attained by a foldable deck chair that contains a seat and a pair of spaced apart front legs. A pair of support members are rotatably retained in the front legs beneath the seat so that the support members may be rotated between a stored position in parallel alignment with the front legs and a raised position generally extending horizontally in front of the seat. A manually operated drive shaft acts through a linkage mechanism to raise and lower the support members. A frame is slidably contained upon the support members within guideways and is further connected to the linkage mechanism so that the frame moves between a retracted position when the support members are in the stored position and an extended position when the support members are in the raised position.

BRIEF DESCRIPTION OF THE DRAWING

For a further understanding of these and objects of the present invention, reference will be made to the following detailed description of the invention which is to be read in association with the accompanying drawing, wherein.

DETAILED DESCRIPTION OF THE INVENTION

Figures 1, 2:
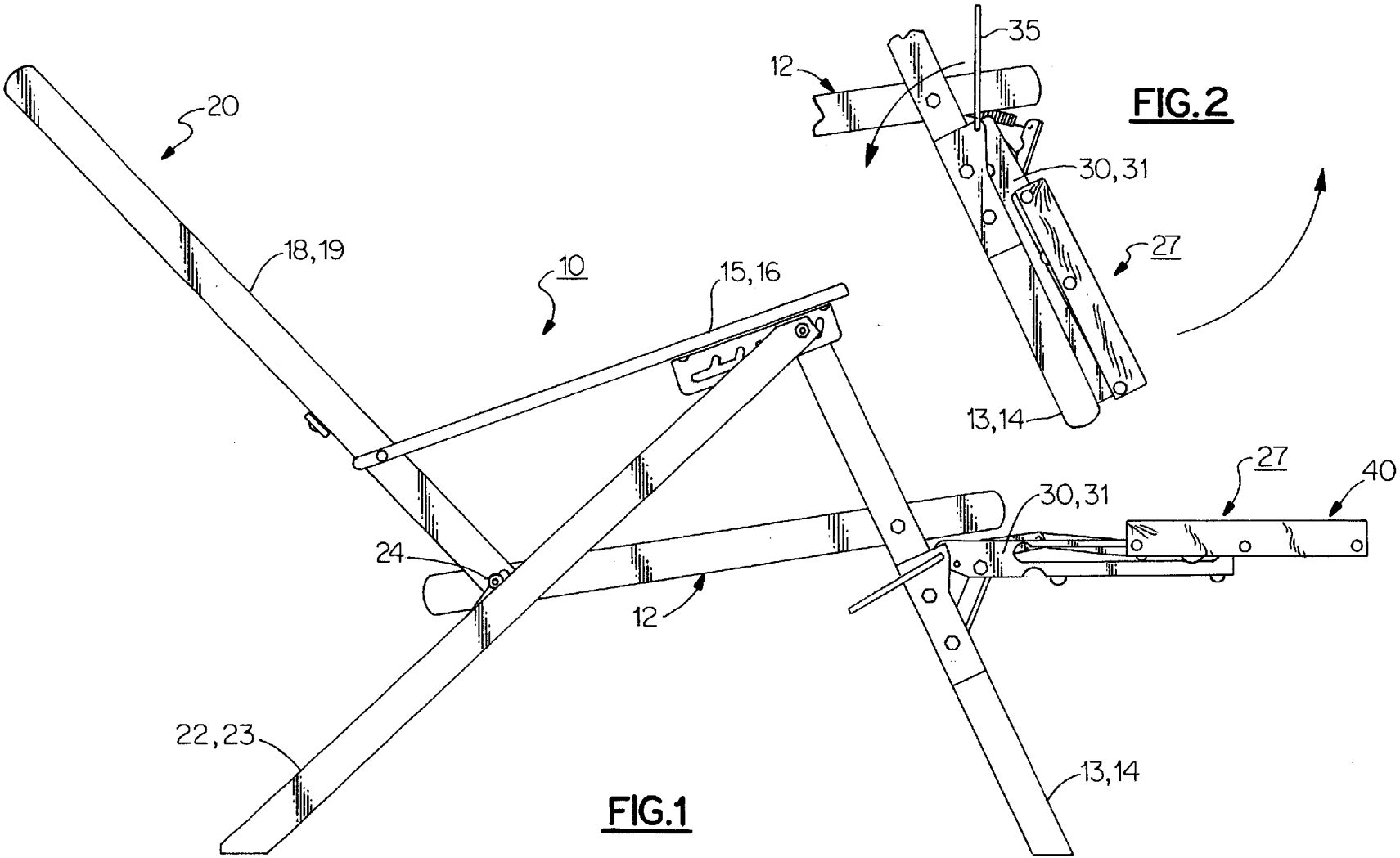
FIG. 1 is a side elevation of a folding deck chair equipped with a retractable leg support unit illustrating the unit in a fully up and extended leg supporting position.
FIG. 2. is a partial side elevation illustrating the leg support unit in a down and retracted position beneath the chair seat.
Figure 3:
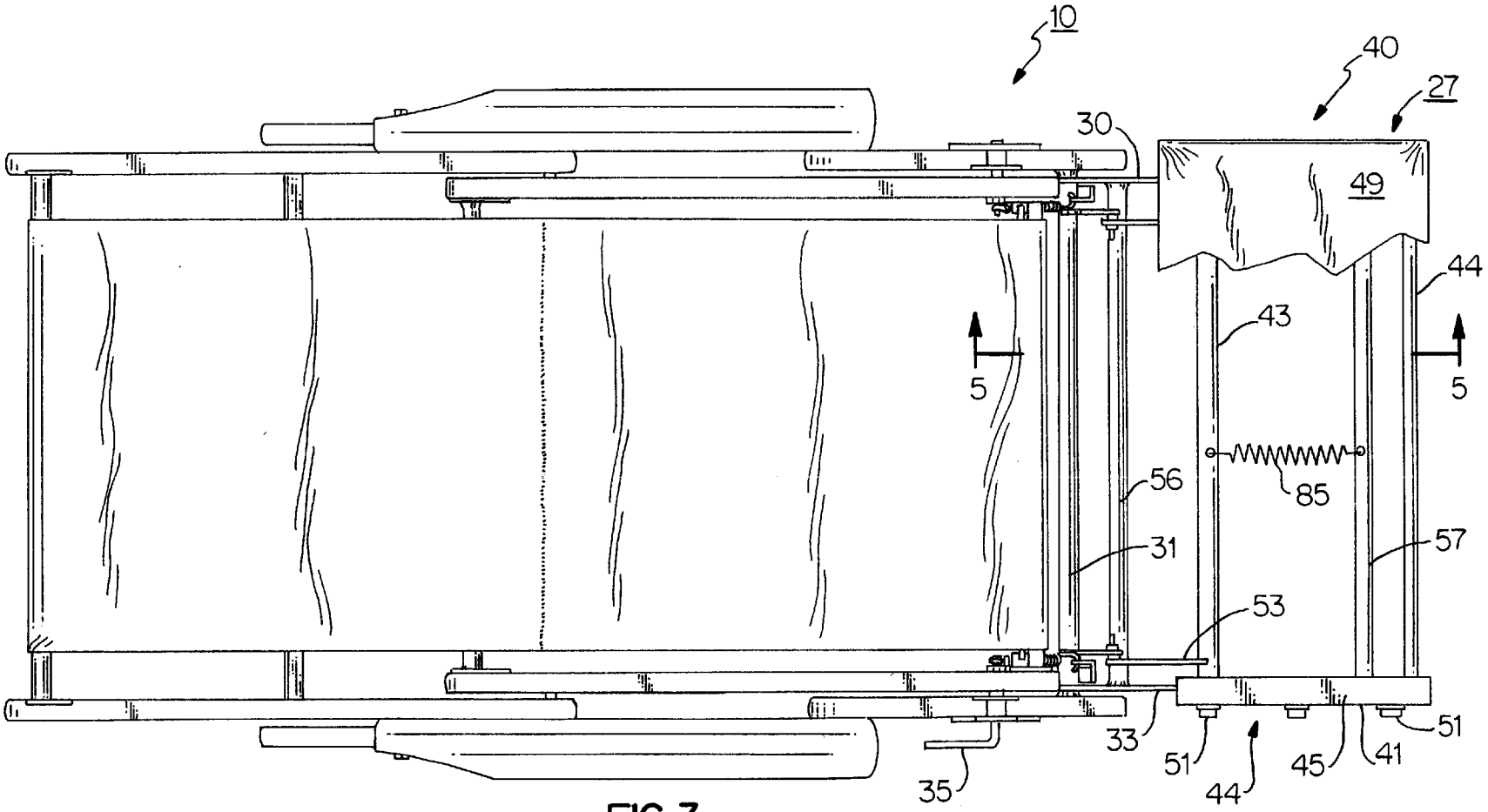
FIG. 3 is a top view of the foldable deck chair with the leg support unit in the up position.

Referring initially to FIGS. 1–3, there is illustrated a folding chair such as a beach or deck chair, generally referenced 10, that embodies the teachings of the present invention. The chair includes a seat 12 that is suspended between two spaced apart front legs 13 and 14. A pair of opposed arm rests 15 and 16 are rotatably attached at their distal ends to the top of the front legs and the arms extend rearwardly and the proximal ends are rotatably secured to opposed risers 18 and 19 that are part of the chair's back rest 20. The lower part of the risers are, in turn, rotatably mounted in the back chair seat. The rear legs 22 and 23 of the chair are slidably mounted in an adjusting bracket secured to the front underside of chair arms and extend rearwardly at an angle so they can rest on the surface supporting the chair. The back of the seat is equipped with laterally extended pins 24 which rest upon the back of the rear legs when the chair is unfolded and placed in an upright position as illustrated in FIG. 1.

The back rest and the seat are covered with a strong fabric material. As is well known in the art, the various components making up the chair are pivotally attached one to the other so that the chair can be folded into a flat unit that can be easily carried and conveniently stored. As noted above, folding chairs of this type are not generally equipped with leg rests because the leg rests cannot be folded into a desired stored position for carrying or storing the chair.

A storable leg rest 27 embodying the teachings of the present invention is suspended between the two front legs of the chair directly below the chair seat. The leg rest includes a pair of elongated support members 30 and 31 that are secured at their proximal ends to a main drive shaft 33. The drive shaft, in turn, is rotatably mounted in a bracket 34 (FIG. 4), secured to the front legs of the chair. The right side of the drive shaft protrudes outwardly from the side of the chair and contains a drive arm 35 that is easily accessible to a person who is seated in the chair. As will be explained in greater detail below, rotating the drive arm in a counterclockwise direction as viewed in FIG. 2, will cause the two main support members 30 and 31 to be raised from a stored position, as illustrated in FIG. 2, to a generally horizontal position, as illustrated in FIG. 1, wherein the support members are extended outwardly from the seat and locked in place. Rotating the drive arm in a clockwise direction will cause the support members to be retracted back into the stored position parallel with and adjacent to the front legs of the chair.

An extendable leg support frame, generally referenced 40, is slidably contained within the support members and is controlled through a linkage assembly, generally referenced 42, so that the frame moves outwardly as the support members are raised to an elevated position thereby considerably increasing the length of the leg rest. Returning the support members to the stored position causes the linkage to draw the frame back along the support members into a retracted position so that the leg support unit can be stowed beneath the seat when the support members are lowered to a stored position as illustrated in FIG. 2.

Figure 4:
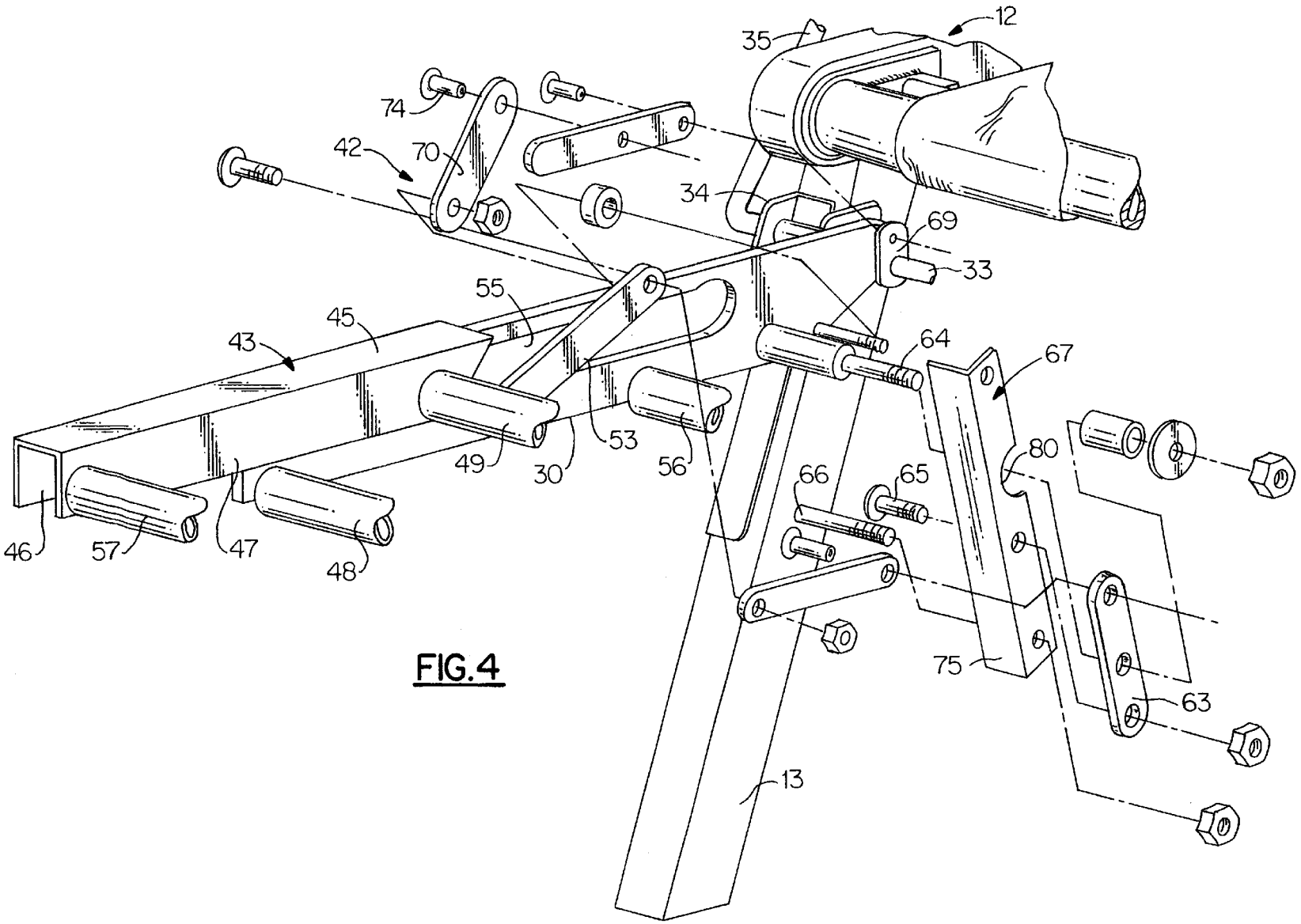
FIG. 4 is an enlarged exploded perspective view showing the linkage mechanism for controlling operation of the leg support unit.
Figure 6:
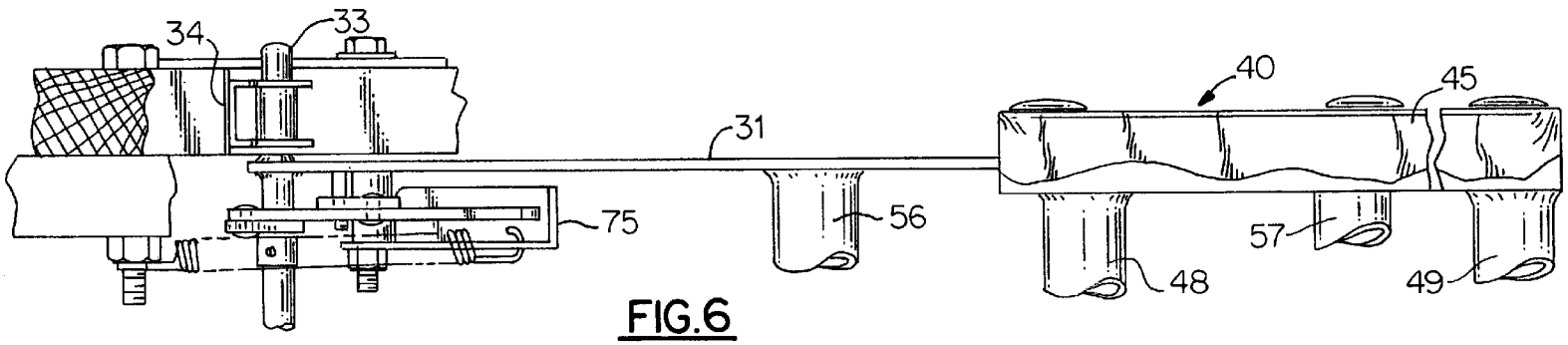
FIG. 6 is a partial top view taken along lines 6—6 in FIG. 5.

With further reference to FIGS. 4–7 there is illustrated in greater detail the linkage assembly 42 for coordinating the motion of the retractable leg rest in response to the rotation of the drive arm 35. One half of the linkage mechanism is illustrated in FIG. 4 with the understanding that the other half of the linkage mechanism is a mirror image thereof and operates in the same manner to extend and retract the leg support frame as the support members are raised and lowered. The leg support frame 40 includes a pair of opposed channel shaped members 43 and 44, each having a top wall 45 that overlies one of the support members and a pair of parallel side walls 46 and 47 that extend downwardly from the top wall to either side of the underlying support members. The inner side walls of the opposed channels are connected by two spaced apart tubular cross members 48 and 49 that hold the channel shaped member apart in assembly. A fabric 49 is passed over the top of the channel shaped members and is secured to the outside side walls 47 of the channels by snap fasteners 51. The rear tubular beam 48 has a pair of rocker arms 53 secured thereto that extend rearwardly behind the leg support frame.

Each of the opposed support members contain an axially extended slotted opening that passes therethrough and forms a guideway 55. The two support members are held in a spaced apart relationship by cylindrical cross members 56 and 57 so that the support members and thus the guideways are held in parallel alignment. A guide roller 60 (FIG. 5) is mounted within each guideway and has raised outer rims for maintaining the roller within a companion guideway so that the roller can move easily along the guideway without being displaced laterally therefrom. Each roller is supported for rotation upon the inside wall of the adjacent channel so that the entire leg support frame can be directed along the guideways.

The two rocker arms 53 that are attached to the rear cross member 48 of the frame 40 and are each rotatably connected by a link 62 to one end of a rotor arm 63. The rotor arm, in turn, is mounted upon a centrally located pivot 64 anchored in the adjacent support member near its proximal end. As can be seen, the pivot and thus the rotor arm, both rotate with the support member as the support member is raised and lowered by the drive shaft. The other end of the rotor arm is rotatably secured by a threaded pin 65 to the body of an actuator arm 67 that is rotatably secured at its proximal end in the adjacent front leg of the chair. The distal end of the actuator arm is, in turn, connected by a pivot pin 67 to the chair seat by means of a tension spring 68 that is arranged to urge the actuator arm in a counter-clockwise direction as viewed in FIG. 5.

The drive shaft is connected to of the linkage assembly by a pair of relatively short rotors 69 rotatably secured to the drive shaft. Each rotor is positioned adjacent to the back of each support member and is coupled to the back of the adjacent support member by a two bar linkage unit made up of links 70 and 71. Link 71 extends beyond the pivot 74 that joins it with link 70 and is adapted to ride in sliding contact with a side rail 75 (FIG. 4) that depends from the actuator arm 67.

Figure 5:
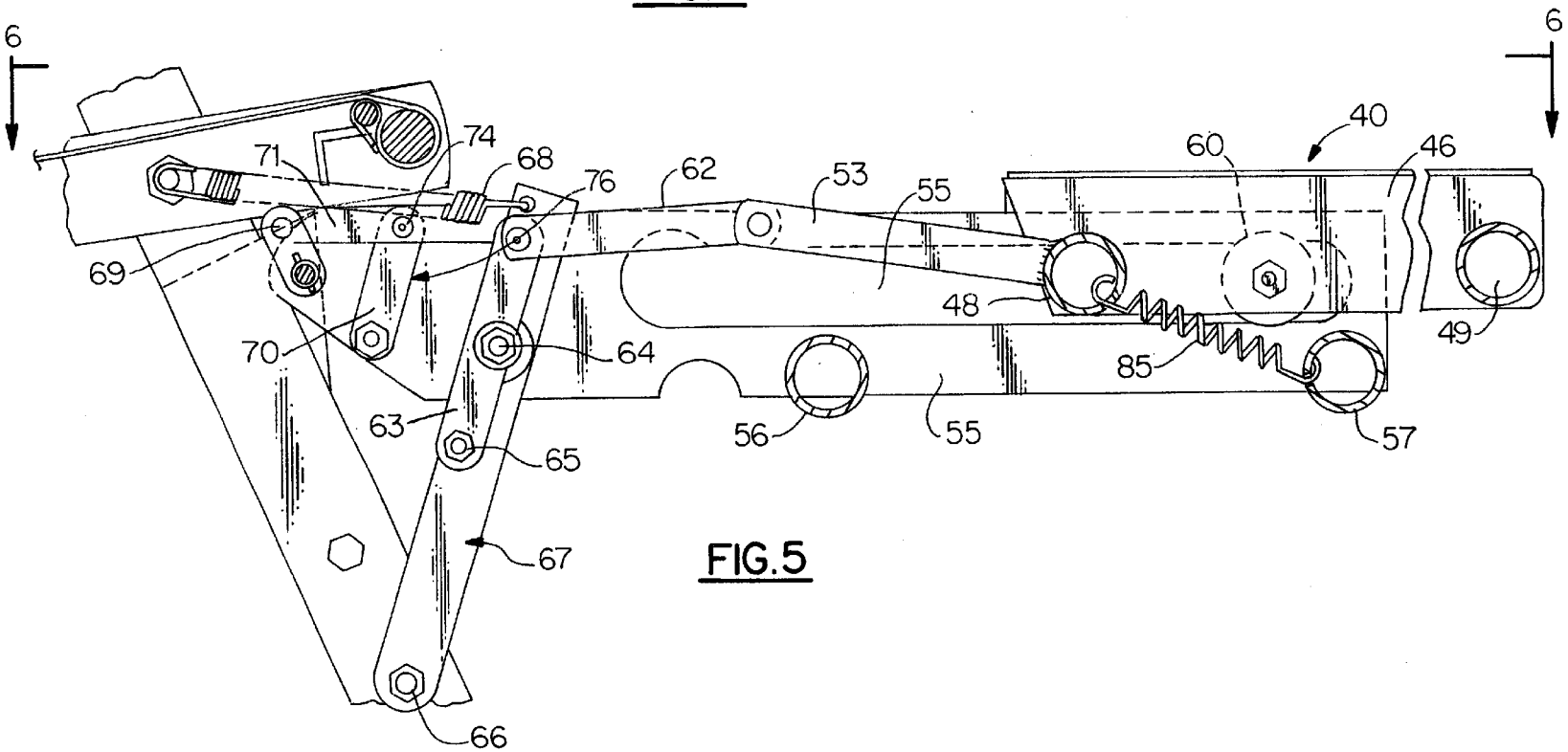
FIG. 5 is an enlarged partial side elevation illustrating in further detail the linkage mechanism with the leg support unit in the up and extended position.
Figure 7:
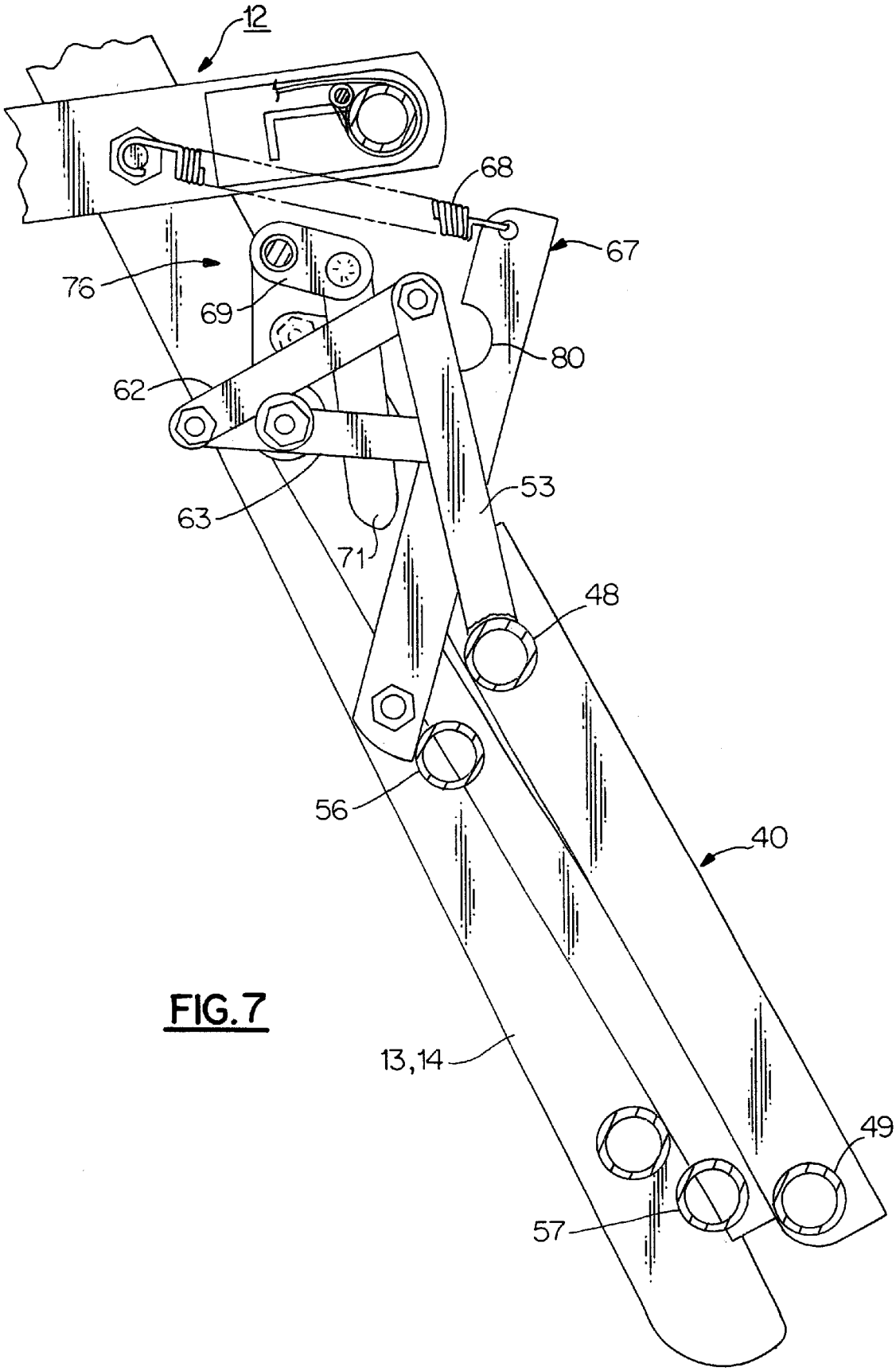
FIG. 7 is an enlarged partial side view further showing the leg support unit in a stored position beneath the chair seat.

The linkage units 70 and 71, along with arm 69, form a control mechanism generally referenced 76 (FIG. 7) that responds to the rotation of the drive shaft to raise and lower the support members as the drive arm is rotated. As best illustrated in FIG. 5, when the drive shaft is rotated in a counter-clockwise direction, the support members are raised to a horizontal or close to horizontal position as shown, and the actuator arms move the leg support frame forward to the extended position. At this time the tension spring 68 becomes extended and creates a high force acting upon the actuator arm 67 urging the arm and the drive shaft to rotate back to their respective stored positions. When the linkage has moved the support members of the leg support system into the fully raised position, as illustrated in FIG. 5, the central pivot 64 of the rotor arm is captured within an arcuate shaped groove 80 formed in the actuator arm 67. At this time, the extended section of the link 71 is in holding contact against the side rail of the actuator arm and thus latches the support arm in a raised position.

Turning the drive arm in a counter-clockwise direction now causes the linkage unit 70 and 71 to scissor together and the extended section of link 71 rides down along the dependent side rail 75 of the actuator arm 57 forcing the arm to rotate in a clockwise direction, thus freeing the pivot 64 from the groove. Under the influence of the moving link 71, actuator arm 63 turns about pivot 64 causing the leg support frame to be pulled back over the support arms. A point is reached wherein the actuator arm is released by the extended end of the link 71 and the spring is now free to act through the control mechanism to pull the support members to a stored position. Ancillary to this action, the linkage also moves the frame rearwardly over the support arms. The linkage is arranged to completely retract the frame over the support members when the members are placed in a fully stored position beneath the chair seat. A second tension spring 85 is mounted between cross member 57 and cross member 48 which becomes extended when the frame is retracted along the support members. The extended spring acts to pull the frame outwardly toward the extended position when the support members are moved into the raised position.

As should be evident from the disclosure above, rotating the drive shaft in a clockwise direction will cause the stored support members to rotate into the raised position and move the leg support frame to the extended position.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A foldable chair containing a seat and a pair of spaced apart front legs for supporting the seat, said chair further including:

a pair of opposed support members, each of said members being is rotatably mounted at a proximal end upon one of the front legs so that each support members can rotate between a stored position adjacent to a front leg and a raised position wherein each said support member extends outwardly from said chair;

actuating means connected to said support members by a manually operated linkage for moving the support members between the stored position and the raised position;

each support member containing an axially extended guideway having a proximal end and a distal end;

a frame slidably contained within said guideway; and said linkage further connected to said frame for moving the frame along the guideway between a fully retracted position when the support members are in a stored position and a fully extended position when the support members are in the raised position;

said frame including a pair of spaced apart channel members each having a top wall overlying one of the support arms and a pair of side walls downwardly depending on either side of said support member and a roller rotatably secured in at least one of said sidewalls that is contained in said guideway.

2. The foldable chair of claim 1 that includes a first spring means acting between the chair and said linkage for urging said support members into the stored position when the support members are rotated to a first given position.

3. The foldable chair of claim 2, wherein said linkage mechanism includes an actuator arm pivotally mounted on each of said support arms, said actuator arm having a proximal end pivotally connected to one of the front legs of said chair and an extended distal end that is connected to an end of said first spring means.

4. The foldable chair of claim 3 wherein said linkage mechanism further includes a link pivotally connected to said actuator arm coupling means for connecting said link to said frame so that said frame is retracted over said support members when the support members are placed in a stored position and is extended outwardly from the support members when the support members are placed in the raised position.

5. The foldable chair of claim 4 that further includes a latching means for latching the said link to said actuator arm when the support members are placed in the raised position whereby the support members are held in said raised position.

6. The foldable chair of claim 5 wherein the latching means is connected to said drive shaft for moving the actuator arm to an unlatched position when the drive shaft is rotated from a support member raised position toward a support member stored position.

7. The foldable chair of claim 1 that further includes a second spring means that acts between the frame and said support member for urging the frame into the fully extended position when said support members are rotated to a second given position.

8. The foldable chair of claim 7, wherein said second spring means is connected between one of said frame cross members and a further cross member connecting the support members so said spring means is extended into a loaded condition when the support members are placed in a stored condition.

9. The foldable chair of claim 1, wherein said channel members are connected by a pair of frame cross members.

* * * * *